US005164145A

United States Patent [19]

Smith

[11] Patent Number: 5,164,145

[45] Date of Patent: Nov. 17, 1992

[54] ROTARY FURNACE OIL SEAL EMPLOYING ENDOTHERMIC GAS PURGE

[75] Inventor: John W. Smith, Brighton, Mich.

[73] Assignee: Thermo Process Systems Inc., Livonia, Mich.

[21] Appl. No.: 595,039

[22] Filed: Oct. 10, 1990

[51] Int. Cl.[5] ..... C21D 9/00

[52] U.S. Cl. ..... 266/44; 266/251; 266/252; 266/262; 432/124; 432/138

[58] Field of Search ..... 266/44, 251, 252, 262; 432/124, 138, 139

[56] References Cited

U.S. PATENT DOCUMENTS

| | | | |
|---|---|---|---|
| 4,288,062 | 9/1981 | Gupta et al. | 266/88 |
| 4,763,880 | 8/1988 | Smith et al. | 266/252 |
| 4,869,730 | 9/1989 | Bhatnagar et al. | 48/196 R |

*Primary Examiner*—R. Dean
*Assistant Examiner*—Margery S. Phipps
*Attorney, Agent, or Firm*—Fish & Richardson

[57] ABSTRACT

A rotary oil seal gas purge system for a rotary carburizing furnace, having a rotatable hearth in a furnace chamber containing a high carbon-potential furnace atmosphere comprising an endothermic carrier gas enriched with a hydrocarbon gas, features gas purge ports located adjacent to the oil seal(s) of the hearth for injecting non-carbon-enriched endothermic gas to purge the high carbon-potential furnace atmosphere from the area adjacent the seal(s) and prevent carbon precipitation into the seal(s). Also disclosed is an oil seal management system for a rotary carburizing furnace including a settling tank for accepting seal oil from the furnace oil seal(s), a pump supply tank for receiving oil from the settling tank, a pump for pumping oil from the pump supply tank through a heat exchanger and to the furnace oil seal(s), and a centrifuge for cleaning seal oil coming from the heat exchanger before returning it to the pump supply tank.

20 Claims, 7 Drawing Sheets

ROTARY FURNACE OIL SEAL EMPLOYING ENDOTHERMIC GAS PURGE

BACKGROUND OF THE INVENTION

This invention relates to rotary carburizing furnaces utilizing a high carbon-potential atmosphere contained within the furnace by oil seals, and particularly to purging the high carbon-potential atmosphere from the vicinity of the oil seals, and to providing a cooling and recirculating management system for the seal oil.

In rotary carburizing furnaces, metal parts are carburized by exposing them to a high carbon-potential, high temperature furnace atmosphere. Typically, the furnace atmosphere is an endothermic carrier gas carbon enriched with a hydrocarbon gas such as methane. While the furnace atmosphere will support gaseous carbon at high temperatures, carbon will precipitate out of the furnace atmosphere if the temperature of the atmosphere drops below the saturation point. Carbon precipitation often occurs in the vicinity of the oil seal or seals of a rotary carburizing furnace since these seals are in contact with the carbon-enriched furnace atmosphere, and are located at a cooler section of the furnace chamber, e.g., below the rotating hearth. Carbon precipitation is exacerbated particularly when the furnace atmosphere is close to carbon saturation, which may be desirable for the carburizing cycle, since only a small temperature decrease is required to cause precipitation.

Carbon precipitation in the vicinity of furnace oil seals causes carbon sludge to form in the seal oil, causing the oil seal to clog quickly. Since seal oil is typically recirculated and cooled to prevent overheating, carbon clogging of the oil seal, and of the recirculation and cooling system, must be prevented. Clogging of the oil seal system can also cause oil overflows onto the plant floor. Mechanical, manual cleaning of the oil seals to prevent or remove clogging requires a costly shutdown of the rotary carburizing furnace and lost production capacity.

Accordingly, it is an object of the invention to provide a method and apparatus for avoiding or minimizing entry of carbon into a fluid seal.

It is a particular object of this invention to minimize or eliminate carbon precipitation in the vicinity of one or more oil seals of a rotary carburizing furnace.

It is another object of this invention to provide an oil seal management system for cooling, cleaning and recirculating oil through the oil seals.

SUMMARY OF THE INVENTION

In general, in one aspect, this invention features a seal gas purge system for a rotary carburizing furnace having a rotatable hearth in a furnace chamber containing a high carbon-potential furnace atmosphere comprising an endothermic carrier gas enriched with a hydrocarbon gas, such as methane. An annular fluid seal, typically an oil seal below the rotatable hearth, prevents the furnace atmosphere from escaping from the furnace chamber through an annular slot formed between the hearth and the outer sidewall of the furnace. In the case of a "donut-shaped" furnace, two concentric annular seals prevent escape of the furnace atmosphere through two annular slots formed between the hearth and inner and outer sidewalls of the furnace. Gas purge inlet ports located around the circumference of the slot(s) permit injection of the endothermic carrier gas only into the slot(s) to purge the high carbon-potential furnace atmosphere from the area above the seal(s) and prevent carbon precipitation into the seal(s).

In another aspect, this invention features an oil seal management system for a rotary carburizing furnace including a settling tank for accepting seal oil from furnace oil seal returns, a pump supply tank for receiving oil from the settling tank, a pump for pumping oil from the pump supply tank through a heat exchanger and to the furnace oil seals, and a centrifuge for continuous cleaning of the seal oil coming from the heat exchanger before returning it to the pump supply tank.

The oil seal gas purge of this invention significantly reduces carbon precipitation into oil seal(s) of a carburizing furnace while allowing maintenance of a precisely controlled, carbon-enriched endothermic gas atmosphere within the main furnace chamber. This greatly reduces the carbon sludge build-up in the oil seal(s) which reduces the probability of unexpected, and hazardous, oil seal overflows to the plant floor due to clogging. Additionally, the oil seal(s) require less frequent cleanings (which require furnace shutdown), thus increasing overall furnace productivity. The seal oil management system of this invention further reduces sludge build-up in the seal oil by continuously centrifuge cleaning the carbon from the oil recirculated to the oil seal(s).

DESCRIPTION OF PREFERRED EMBODIMENTS

Figure 1:
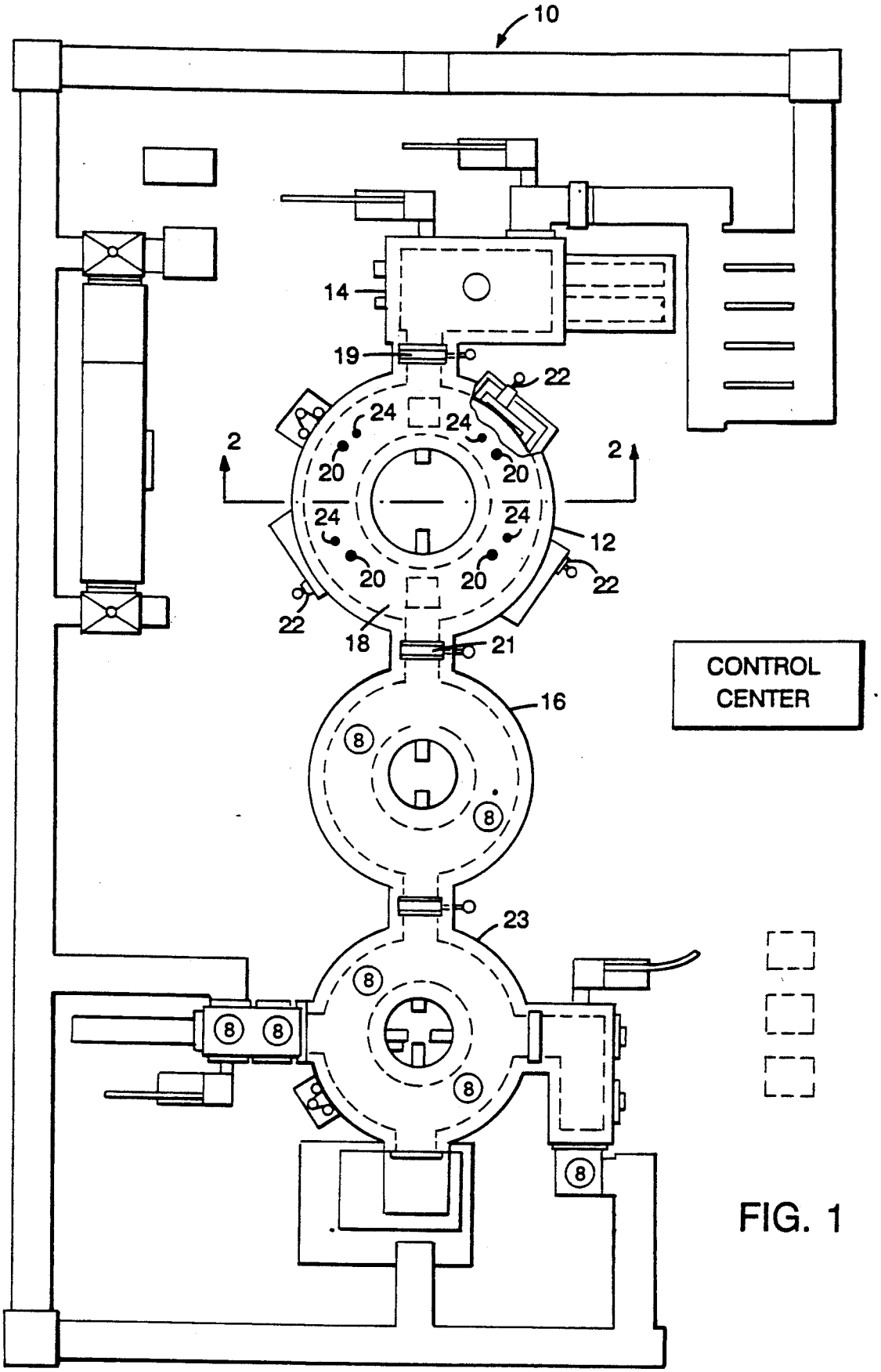
FIG. 1 is a plan view of a continuous carburizing furnace system including a purge system for a "donut" type rotary carburizing furnace according to a preferred embodiment of the invention.

With reference to FIG. 1, a continuous carburizing furnace system 10 (shown by way of illustrating a furnace system having a rotary carburizer of one type, but without intent to limit the invention to any particular furnace system arrangement) includes several interconnected furnaces each forming a separate furnace chamber in which trays loaded with parts are processed during a carburizing process. (As used herein the term "carburizing" is intended to include processing not only in carbon-rich atmospheres but also in carbon/nitrogen (carbonitriding) atmospheres). Such a furnace system is fully described in U.S. Pat. No. 4,763,880, assigned to the assignee of this invention, and whose entire disclosure is incorporated herein by reference.

In particular, furnace system 10 includes a rotary carburizing furnace 12 of the "donut" type (i.e., with a central hole) positioned to accept parts from a preheat furnace 14 and discharge parts to a rotary diffusion furnace 16. Carburizing furnace 12 includes an enclosed annular furnace chamber 18, into which parts to be carburized enter from preheat furnace 14 through door 19, and from which carburized parts exit to diffusion furnace 16 through door 21, thereafter passing to an equalizing furnace 23.

Carburizing furnace chamber 18 is filled with a high temperature, high carbon-potential, gaseous atmosphere to promote carbonization of parts in the furnace chamber, i.e., uniform carbon penetration into all surfaces of the part. This high carbon-potential atmosphere is provided by blending an endothermic carrier gas and a hydrocarbon gas (such as methane) and delivering the gaseous mixture to the main portion of the furnace chamber 18 through atmospheric inlet ports 20 in the chamber roof. Fans such as fans 22 in the outer sidewall of the furnace 12 promote annular circulation of the atmosphere within the furnace (roof fans may also be utilized, if desired).

The carbon-potential of the furnace atmosphere is controlled by blending the endothermic gas and the hydrocarbon gas in a proportion determined by suitable atmosphere sensing probes (not shown) located in the walls of the furnace chamber. (For discussion of different types of suitable probes, see U.S. Pat. No. 4,288,062, whose entire disclosure is incorporated herein by reference.) A typical carbon-potential for the furnace chamber atmosphere may, for example, be in the range of 1–1.35 percent, where carbon-potential is essentially the concentration of carbon (by weight) in the surface of a metal part in equilibrium with the furnace atmosphere. The furnace atmosphere is typically maintained at a temperature of approximately 1700° F., controlled by temperature sensors 24 in the roof of the furnace chamber.

Figure 2:
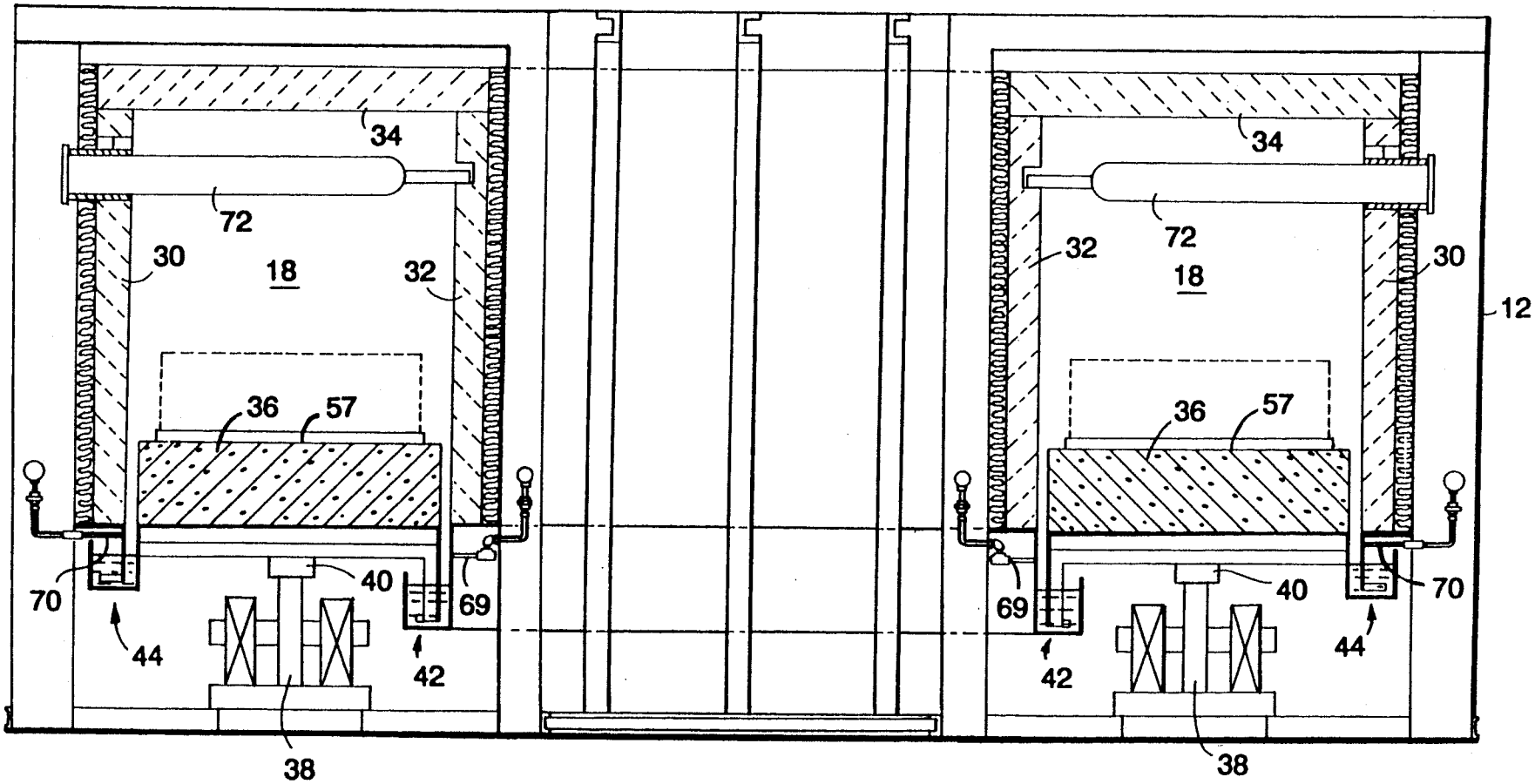
FIG. 2 is a cross-sectional view of the rotary carburizing furnace taken along lines 2—2 of FIG. 1 exposing the internal furnace chamber.

With reference to FIG. 2, annular furnace chamber 1B is defined by outer sidewall 30, inner sidewall 32, roof 34, and rotatable hearth 36, which are preferably formed of, or lined with, insulating refractory materials. Parts are moved within furnace chamber 18 by rotating hearth 36 like a turntable. Except when stopped to receive or discharge parts, the hearth is typically rotated continuously—e.g., up to one revolution per minute. To facilitate rotation, hearth 36 is supported around its circumference by several stationary wheels 38 which run on a circular track 40 attached to the underside of the hearth.

Figure 2A:
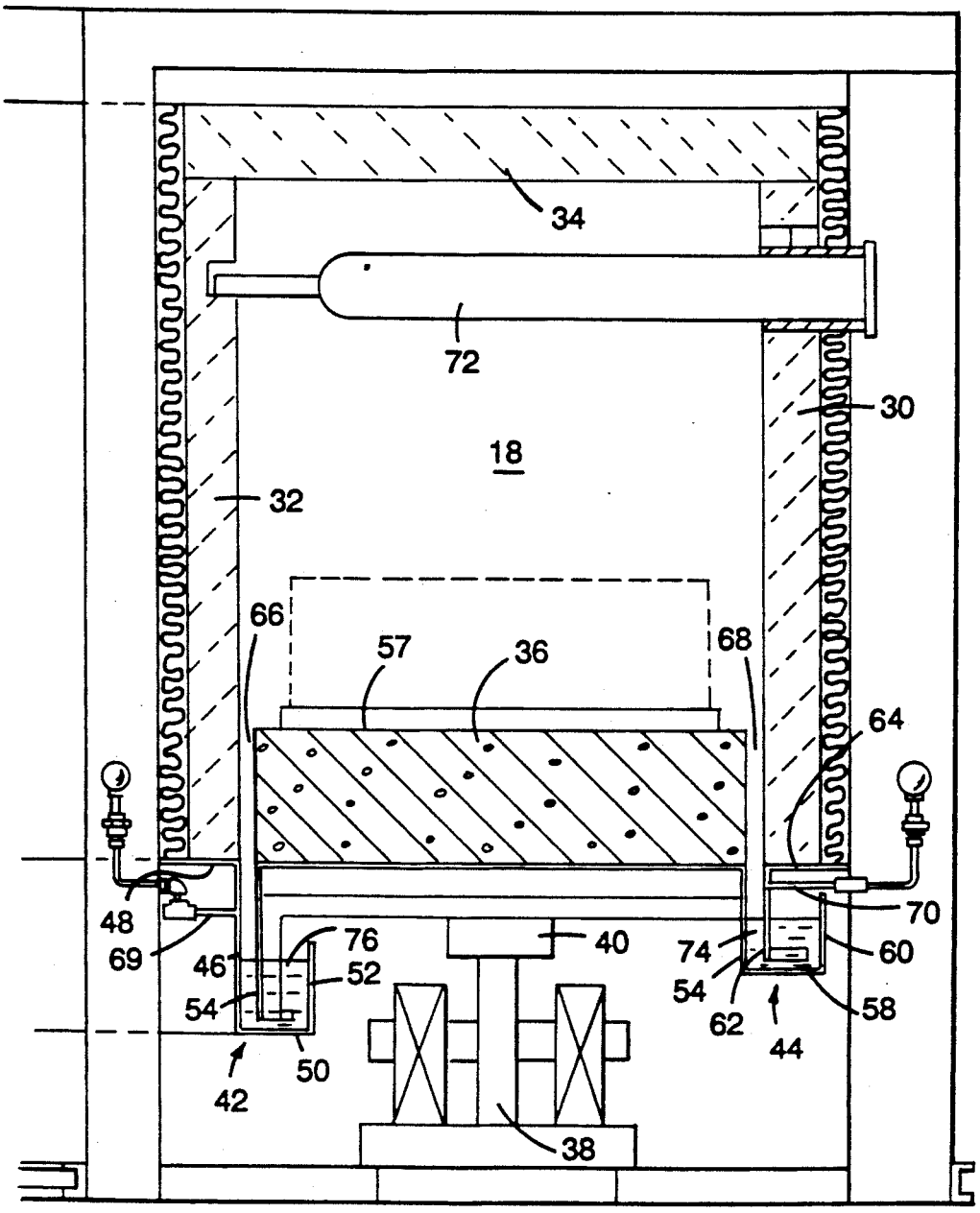
FIG. 2*a* is a close-up of the right hand side of the cross-sectional view FIG. 2 showing in detail the rotary furnace oil seals and gas purge ports according to the invention.

With reference to FIG. 2 and FIG. 2*a*, an inner oil seal 42 and an outer oil seal 44 are positioned under the rotatable hearth 36 to seal the atmosphere within furnace chamber 18 while allowing the hearth to rotate freely. Inner oil seal 42 includes a stationary oil trough (could be a rotatable trough, if desired) defined by a cylindrical inner metal sidewall 46 extending from the bottom plate 48 of inner furnace sidewall 32, a bottom plate portion 50 extending under hearth 36, and a cylindrical outer metal sidewall 52 coaxial with inner metal sidewall 46 and extending up toward the bottom of hearth 36. A cylindrical center dividing skirt wall 54 projects coaxially from the bottom plate 56 of rotatable hearth 36 into the trough between inner metal sidewall 46 and outer metal sidewall 52, without meeting bottom plate 50.

Outer oil seal 44 includes a rotary trough defined by a cylindrical inner metal sidewall 54 extending from the bottom plate 56 of hearth 36, a bottom plate portion 58 extending under outer furnace sidewall 30, and a cylindrical outer metal sidewall 60 extending up toward the bottom of outer furnace sidewall 30. A cylindrical center dividing skirt wall 62 projects coaxially from the bottom plate 64 of furnace sidewall 30 into the trough between inner metal sidewall 54 and outer metal sidewall 60, without meeting bottom plate 58.

An inner annular slot 66 is formed between inner sidewall 32 and hearth 36 and extends from the upper surface 57 of the hearth to inner oil seal 42. Similarly, an outer annular slot 68 is formed between outer sidewall 30 and hearth 36 and extends coaxially with the outer sidewall from the upper surface 57 of the hearth to outer oil seal 44. The slots 66 and 68 form a confined portion of the furnace chamber 18 whose temperature is typically lower than the temperature of the main portion above the hearth 36.

The furnace atmosphere is heated to approximately 1700° F. by radiant heater tubes 72 (FIG. 2) distributed around the circumference of the furnace chamber adjacent to roof 34 and which extend radially across the furnace chamber between outer sidewall 30 and inner sidewall 32. Typically, the temperature of the atmospheres within inner annular slot 66 and outer annular slot 68 is significantly lower than the temperature of the atmosphere within the upper portion of the furnace chamber. For instance, the atmosphere temperature in the center of the furnace chamber may be approximately 1700° F., while the atmosphere temperature of either annular slot may be only 1000° F. or less adjacent to its corresponding oil seal. As a result, carbon tends to precipitate out of the carbon-enriched furnace atmosphere within the annular slots and foul the oil contained in inner oil seal 42 and outer oil seal 44. The likelihood of carbon precipitation increases as the carbon-potential of the furnace chamber atmosphere nears saturation since only a small decrease in atmosphere temperature is required to cause carbon precipitation.

To minimize carbon precipitation, several endothermic gas purge ports 69 and 70 are distributed around the circumference of the inner and outer annular slots, 66 and 68 respectively. Each endothermic gas purge port directs a steady stream of low carbon-potential endothermic carrier gas (e.g., a gaseous mixture composed primarily of nitrogen, hydrogen and carbon monoxide) into its respective annular slot, immediately (e.g., 1–2 inches) above the oil level of the respective oil seal, to provide an atmosphere pressure within the slot slightly greater than that of the upper main portion of the furnace chamber 18. This results in a net flow of low carbon-potential endothermic gas out of the annular slots and into the furnace chamber 18, which prevents the high-carbon-potential furnace atmosphere of the furnace chamber from migrating into the annular slots where carbon precipitation is more likely to occur.

Figure 3:
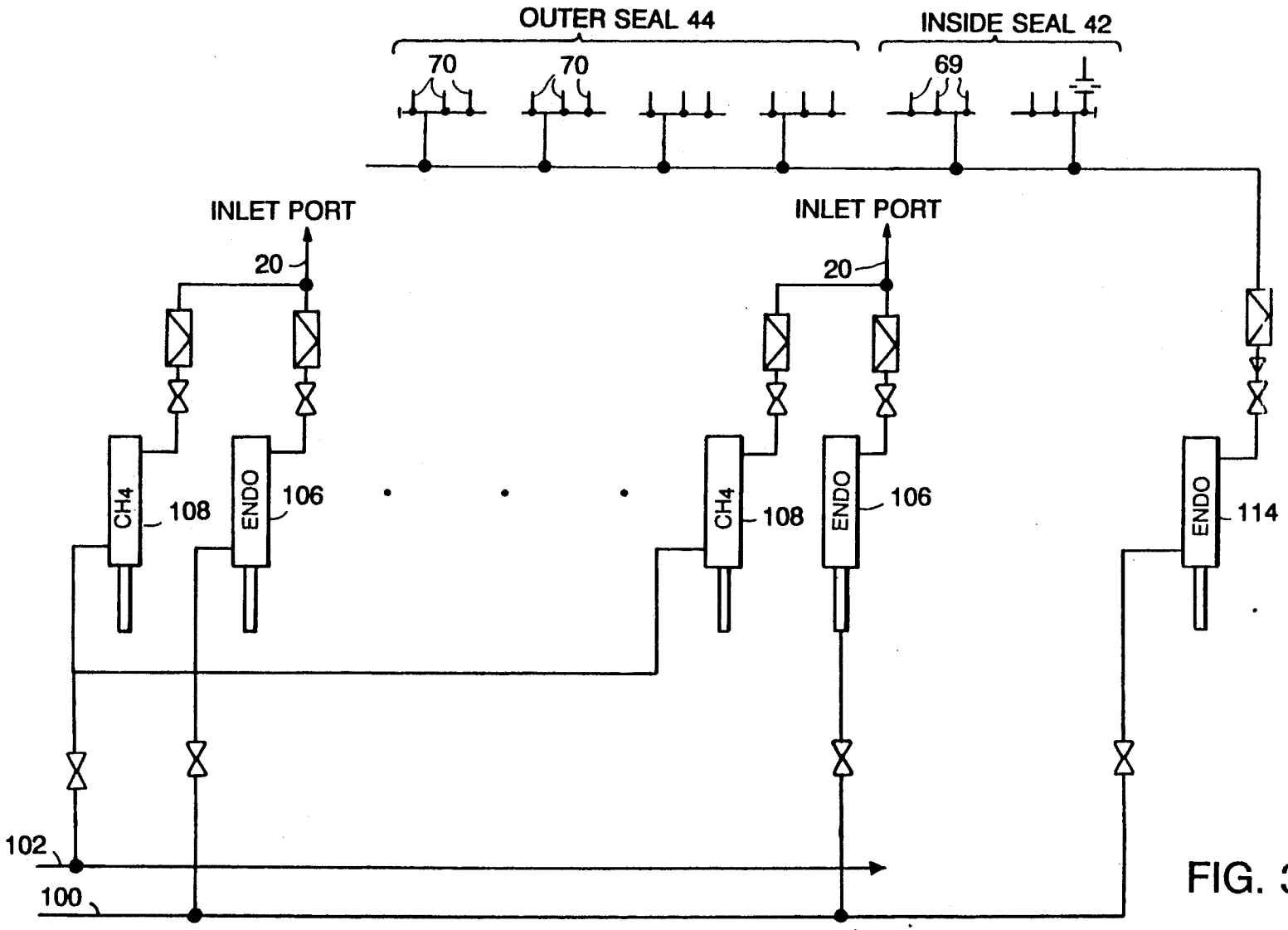
FIG. 3 is a schematic diagram of an endothermic and methane gas distribution system used in conjunction with the rotary carburizing furnace of FIG. 1.

With reference to FIG. 3, the high carbon-potential atmosphere of furnace chamber 18 is generated by mixing endothermic gas input along a line 100 with methane input along a line 102, with the mixture applied at each of the furnace chamber roof inlet ports 20 (FIG. 1) distributed around the furnace chamber. The carbon-potential of the mixed gas injected at each furnace chamber inlet port 20 is controlled by adjusting the methane flow with flow regulators 108. Flow regulators 106 typically pass a constant flow of endothermic gas to mix with the methane flowing through flow regulators 108.

The low carbon-potential atmosphere of annular slots 66 and 68 is generated by injecting a portion of the low carbon-potential endothermic carrier gas from line 100 at endothermic gas purge ports 69 and 70 uniformly distributed around the circumference of the inner annular slot 66 and outer annular slot 68, respectively. A gas flow regulator 114 controls the flow of endothermic gas from line 100 to endothermic gas purge ports 69 and 70. As indicated in FIG. 3, there are a larger number of gas purge ports 70 around the larger circumference of outer annular slot 68 than there are gas purge ports 69 around the smaller circumference of inner annular slot 66 to keep the spacing between adjacent gas purge inlet ports approximately the same. Also, the total flow of gas input to the furnace chamber 18 through the roof inlet ports 20 and the endothermic gas purge ports 69 and 70 is typically somewhat greater (e.g., 30–60% higher) than the total gas flow to the furnace chamber if the gas purge were not utilized.

Figure 4:
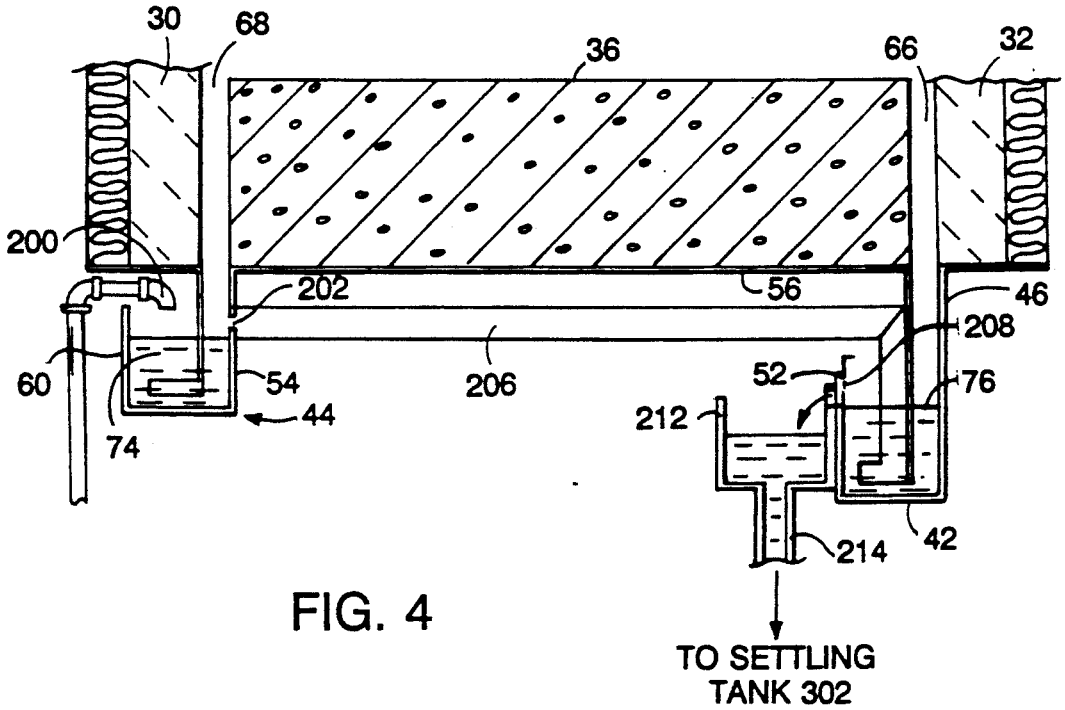
FIG. 4 is a cross-sectional view of the oil seals of the rotary carburizing furnace of FIG. 1, corresponding to the left-hand side of the cross-sectional view of FIG. 2, showing a seal oil filling and return system according to the invention.

With reference to FIG. 4, cleaned and cooled oil, supplied by the oil cooling and cleansing system described below, is continuously circulated through oil seals 44 and 42, first filling outer oil seal 44 by means of oil inlets 200 positioned over the top of oil seal outer wall 60. Typically two or three oil inlets are distributed around the circumference of outer oil seal 44. Oil in outer oil seal 44 rises to an oil level 74 equal to the level of spillway 202 located on the oil seal inside metal wall 54 below the top of outer wall 60. Spillway 202 leads to conduit 206 which runs under hearth 36 and terminates near the bottom of inner oil seal 42. Thus, oil that overflows outer oil seal 44 enters spillway 202 and flows into inner oil seal 42.

Oil in inner oil seal 42 rises to an oil level 76 equal to the level of overflows 208 located on the outer metal wall 52 of inner oil seal 42 below the top of outer metal wall 52 and below the level of spillway 202 of outer oil seal 44. Overflows 208 lead to several oil overflow weir boxes 212 located around the circumference of the inner oil seal, then to collection conduits 214 which return seal oil to the oil cleansing and cooling system described below.

Figure 5:
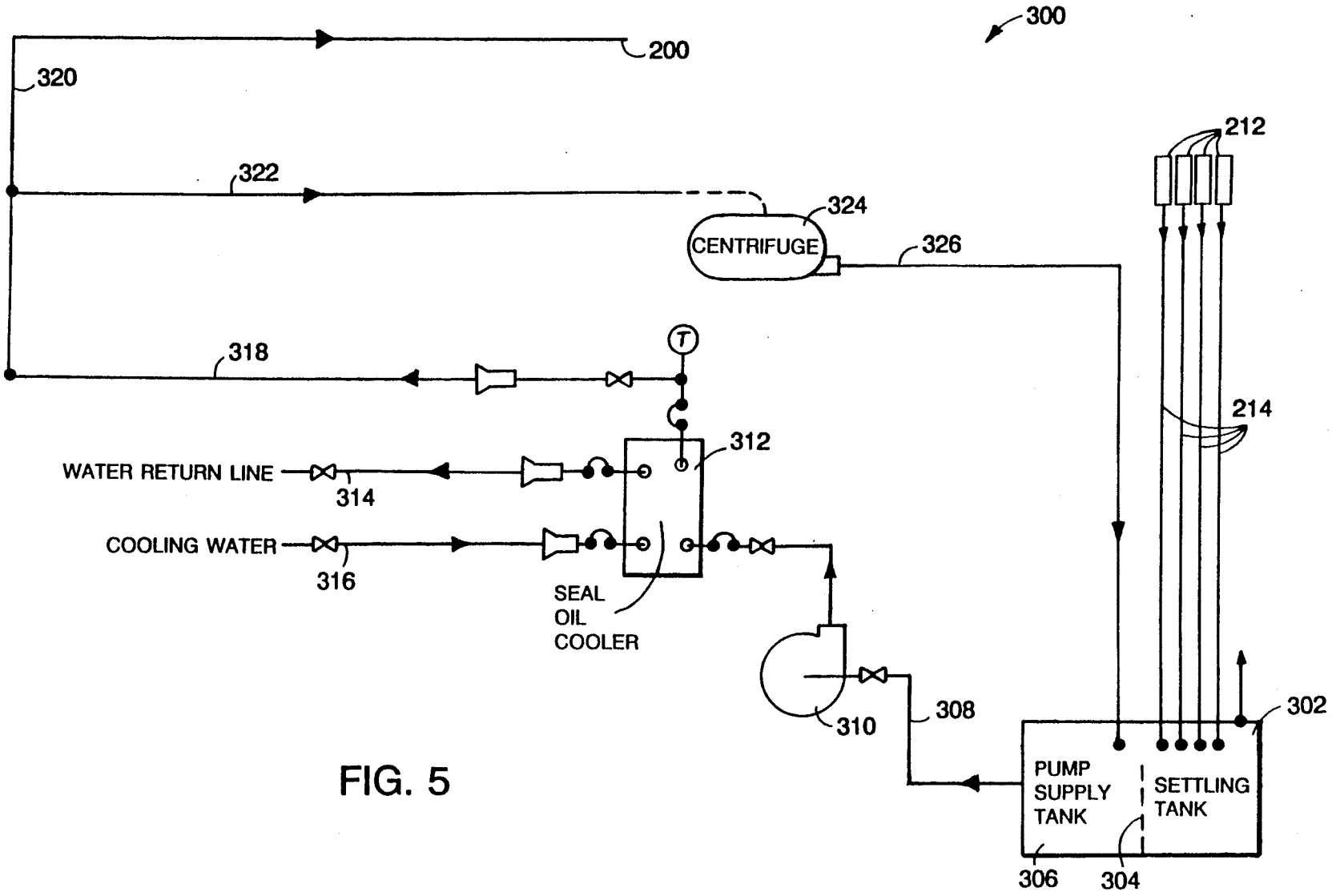
FIG. 5 is a schematic diagram of a seal oil cooling and cleansing management system used in conjunction with the seal oil filling and return system of FIG. 4.

With reference to FIG. 5, a seal oil cleansing and cooling system 300 for the oil seals of a rotary carburizing furnace receives contaminated and heated seal oil, gravity drained from the oil seals through oil seal overflow weir boxes 212 and collection conduits 214 (FIG. 4) into a settling tank 302. Oil in settling tank 302 flows over an internal tank weir 304, into a pump supply tank 306, thereby allowing most of any oil sludge in the oil entering settling tank 302 to collect in the bottom of settling tank 302.

Oil from pump supply tank 306 is drawn through a conduit 308 to a pump 310 which pumps the oil through a heat exchanger 312. Typically, the oil returned from the oil seals has a temperature of over 100° F. (typically about 130° F.), which heat exchanger 312 reduces to about 100° F. or below, depending on the temperature and flow rate of cooling water supplied through a conduit 316. A constant supply of cooling water flows into heat exchanger 312 through the conduit 316 and heated water is exhausted through a conduit 314. Typically, a second, redundant heat exchanger and pump (not shown) are provided to assure no loss of circulation and cooling for the oil provided to the oil seals.

Oil flows out of heat exchanger 312 through a conduit 318, and is subsequently split between a conduit 320, which leads to oil seal oil inlets 200 (FIG. 4) and a conduit 322 which leads to a centrifuge 324. (If desired, a portion of the cooled oil from heat exchanger 312 may also be passed directly to the oil inlets (not shown) for the inner oil seal 42, as by a split of conduit 320 into two conduits). Centrifuge 324 operates to remove impurities suspended in the oil, particularly carbon deposited in the oil by means of carbon precipitation in the vicinity of the oil seals as discussed above. A conduit 326 returns cleansed oil from centrifuge 324 to pump supply tank 306.

Operation

Typically, the atmosphere of the carburizing rotary furnace consists of an endothermic carrier gas enriched with methane, $CH_4$, to provide a high-potential of carbon for carburizing. The non-enriched, low carbon-potential endothermic carrier gas is well suited for use as the purge gas injected into annular slots 66 and 68 through endothermic gas purge ports 69 and 70, respectively. The endothermic carrier gas itself has a low carbon-potential, while the gaseous atmosphere in the furnace chamber is a combination of methane and the same endothermic carrier gas. In the rotary furnace shown and described herein, the carrier gas is preferably an A.G.A. 302 analysis endothermic gas, ie., substantially 40% $N_2$, 40% $H_2$ and 20% CO. Sufficient methane is added to create a 1.35 carbon-potential atmosphere at 1700° F., which is very close to saturation. The endothermic and methane atmosphere within the furnace chamber is constantly replenished, averaging 3 to 5 volume changes per hour. Endothermic gas flow into the furnace chamber typically remains constant, while the flow of methane into the chamber changes as required for the type of parts being carburized, ie., parts with large surface areas absorb more available carbon than parts with smaller surface areas. A significant proportion of the total endothermic gas flow present in the furnace chamber enters the chamber through the gas purge ports. Continuous rotation of the hearth, as well as atmosphere circulation within the furnace chamber from the sidewall fans 22 (FIG. 1), cause the endothermic atmosphere entering the furnace chamber through the gas purge ports to mix rapidly with the enriched endothermic/methane atmosphere and form a homogenous furnace chamber atmosphere.

Without the use of endothermic gas purge ports 69 and 70 of this invention, the total flow of gases into the furnace chamber, through roof inlets 20 (FIG. 1), could average about 1200 cubic feet per hour (CFH). Use of the gas purge ports may increase the total flow of gases into the furnace chamber to about 1650 CFH to 2100 CFH, with about 900 CFH of carbon-enriched endothermic gases flowing into the chamber through the roof inlets, and about 750 CFH to 1200 CFH of non-enriched endothermic gases flowing into the chamber via the gas purge ports and annular slots. Up to about 25%, or 225 CFH, of the 900 CFH of carbon-enriched endothermic gases is methane (larger percentages of methane could cause sooting of the roof inlets). The increased flows are required to sufficiently pressurize the annular slots, while maintaining the proper proportion of endothermic gas to methane within the chamber. The annular slots are typically pressurized to about 0.1" water column above that of the main portion of the furnace chamber 18, which assures gas flow from the bottom of the annular slots adjacent the oil seals to the top of the annular slots and into the main portion of the furnace chamber. One advantage of increasing the flow of gases into the furnace chamber is a resulting fresher atmosphere within the chamber.

Figure 6:
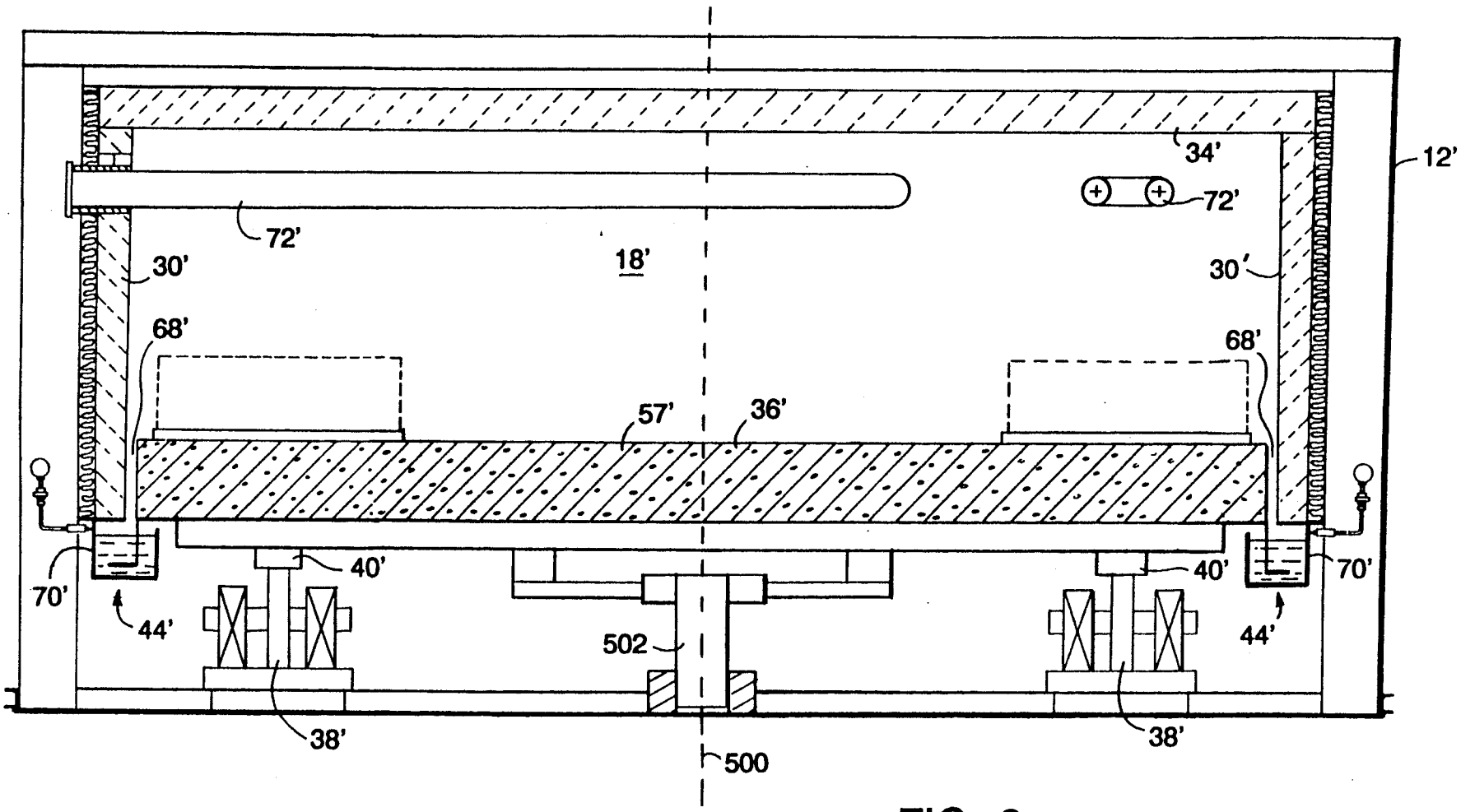
FIG. 6 is a cross-sectional view of the "pancake" type rotary carburizing furnace including a purge system according to another preferred embodiment of this invention.

Other embodiments are within the following claims. For example, with reference to FIG. 6, the gas purge may be applied not only to the rotary carburizing furnaces of the "donut" type with inner and outer oil seals, but also to rotary carburizing furnaces of the "pancake" type 12' which have but a single oil seal 44' and annular slot 68' between a rotatable disc-shaped hearth 36' and an outer wall 30' (i.e., have no inner oil seal and typically no inner wall). Hearth 36' is supported around its circumference by several stationary wheels 38' which run on a circular track 40' attached to the underside of the hearth. The hearth is rotated about a central axis 500 on a rotatable centerpost 502 also attached to the underside of the hearth. Several endothermic gas purge ports 70' are distributed around annular slot 68' to direct a steady stream of low carbon-potential endothermic carrier gas into the slot immediately above oil seal 44' to provide an atmosphere pressure within the slot slightly greater than that of the upper main portion of the furnace chamber 18'.

The gas purge of this invention may also be applied to any carburizing furnace in which it is desired to exclude carbon-enriched gas from an area attached to or part of the furnace chamber. The gas purge may also be applied to systems other than a rotary carburizing furnace, such as where a carrier gas is mixed with a second gas component to form an atmosphere within a chamber, and the second gas component needs to be excluded from an area attached to or part of the chamber. Further, the oil seal management system of this invention may be applied to any system utilizing an oil seal.

I claim:

1. An apparatus for purging carbon-enriched gas from the vicinity of a liquid seal in a rotary carburizing furnace, the furnace having defined therein a furnace chamber including (i) a main portion above a rotatable hearth, and (ii) a confined portion adjacent to and above the liquid seal and which includes a gap between the hearth and a wall of the furnace, comprising:

means for supplying a flow of a non-carbon-enriched carrier gas and a hydrocarbon gas to the main portion of the furnace chamber of the rotary carburizing furnace to establish a carbon-enriched atmosphere in the main portion, and means for injecting a separate flow of said carrier gas into the confined portion of the furnace chamber near the liquid level of the liquid seal with sufficient pressure to cause said separate flow of carrier gas to flow towards and into the main portion of the furnace chamber and inhibit said carbon-enriched atmosphere from entering the confined portion.

2. The apparatus of claim 1 wherein said means for injecting a separate flow of said carrier gas into the confined portion comprises at least one gas purge inlet port communicating with the confined portion of the furnace chamber and coupled to a source of said carrier gas.

3. The apparatus of claim 2 further comprising a gas flow regulator coupled between said gas purge inlet port and said source of said non-carbon-enriched carrier gas for regulating the flow of said carrier gas into the confined portion of the furnace.

4. The apparatus of claim 1 wherein said means for supplying a flow of said non-carbon-enriched carrier gas and hydrocarbon gas to the main portion of the furnace comprises at least one atmosphere inlet port communicating with the main portion of the furnace and coupled to a source of said non-carbon-enriched carrier gas and a source of said hydrocarbon gas.

5. The apparatus of claim 4 further comprising a first gas flow regulator coupled between said atmosphere inlet port and said source of non-carbon-enriched carrier gas for regulating the flow of said carrier gas to the main portion of the furnace, and a second gas flow regulator coupled between said atmosphere inlet port and said source of hydrocarbon gas for regulating the flow of said hydrocarbon gas to the main portion of the furnace.

6. The apparatus of claim 4 wherein said means for injecting a separate flow of said carrier gas into the confined portion comprises at least one gas purge inlet port communicating with the confined portion of the furnace chamber and coupled to a source of said carrier gas.

7. The apparatus of claim 6 further comprising:

a first gas flow regulator coupled between said atmosphere inlet port and said source of non-carbon-enriched carrier gas for regulating the flow of said carrier gas to the main portion of the furnace, a second gas flow regulator coupled between said atmosphere inlet port and said source of hydrocarbon gas for regulating the flow of said hydrocarbon gas to the main portion of the furnace, and a third gas flow regulator coupled between said gas purge inlet port and said source of said non-carbon-enriched carrier gas for regulating the flow of said carrier gas into the confined portion of the furnace.

8. A method for purging carbon-enriched gas from the vicinity of a liquid seal in a rotary carburizing furnace, the furnace having defined therein a furnace chamber including (i) a main portion above a rotatable hearth, and (ii) a confined portion adjacent to and above the liquid seal and which includes a gap between the hearth and a wall of the furnace, comprising:

supplying a flow of a non-carbon-enriched carrier gas and a hydrocarbon gas to the main portion of the furnace chamber of the rotary carburizing furnace to establish a carbon-enriched atmosphere in the main portion, and injecting a separate flow of said carrier gas into the confined portion near the liquid level of the liquid seal with sufficient pressure to cause said separate flow of carrier gas to flow towards and into the main portion of the furnace chamber and inhibit said carbon-enriched atmosphere from entering the confined portion.

9. A rotary carburizing furnace comprising:

an annular furnace chamber having coaxial inner and outer walls, an annular roof, and a rotatable annular hearth, an inner annular slot between said hearth and said inner wall, said inner slot extending coaxially from the top surface of said hearth to an annular inner seal below said hearth, an outer annular slot between said hearth and said outer wall, said outer slot extending coaxially from the top surface of said hearth to an annular outer seal below said hearth, at least one atmosphere inlet port communicating with said furnace chamber for delivering a carrier gas and a hydrocarbon gas to said furnace chamber, and at least one purge inlet port communicating with each of said inner and outer annular slots for delivering carrier gas to said respective slot.

10. The rotary carburizing furnace of claim 9 wherein said inner and outer seal each comprise an oil seal.

11. The rotary carburizing furnace of claim 10 further comprising:

at least one oil outlet port coupled to said outer oil seal for supplying oil to said outer oil seal, at least one first overflow port in said outer oil seal coupled to said inner oil seal for supplying oil to said inner oil seal, at least one second overflow port in said inner oil seal coupled to a settling tank for returning oil from said inner oil seal to said settling tank, a pump supply tank coupled to said settling tank for receiving said oil from said settling tank, a pump having an input coupled to said pump supply tank for receiving oil from said pump supply tank, and an output for supplying oil under pressure, a heat exchanger having an input coupled to said output of said pump for receiving oil from said pump, and an output for supplying oil cooled by said heat exchanger, and a centrifuge for cleansing said oil, having an input coupled to said output of said heat exchanger for receiving cooled oil from said heat exchanger, and an output coupled to said pump supply tank for supplying cleansed oil to said pump supply tank, wherein said heat exchanger output is also coupled to said oil outlet port for supplying cooled oil to said outer oil seal.

12. The rotary carburizing furnace of claim 9 wherein a plurality of said purge inlet ports are distributed around the circumference of each of said inner and outer slots.

13. The rotary carburizing furnace of claim 9 wherein said plurality of said purge inlet ports are distributed substantially uniformly.

14. The rotary carburizing furnace of claim 9 further comprising:

at least one carrier gas flow regulator having an input for coupling to a carrier gas source, and an output coupled to at least one of said atmosphere inlet ports, at least one hydrocarbon gas flow regulator having an input for coupling to a hydrocarbon gas source, and an output coupled to said output of at least one said carrier gas flow regulator, and at least one purge gas flow regulator having an input for coupling to a carrier gas source, and an output coupled to at least one of said purge gas inlet ports.

15. A rotary carburizing furnace comprising:

a furnace chamber defined by a rotatable disc-shaped hearth, a roof, and a cylindrical wall surrounding said hearth and supporting said roof above said hearth, an annular slot between said hearth and said wall, said slot extending coaxially from the top surface of said hearth to an annular seal below said hearth, at least one atmosphere inlet port communicating with said furnace chamber for delivering a carrier gas and a hydrocarbon gas to said furnace chamber, and at least one purge inlet port communicating with said annular slot for delivering carrier gas to said annular slot.

16. The rotary carburizing furnace of claim 15 wherein said seal comprises an oil seal.

17. The rotary carburizing furnace of claim 16 further comprising:

at least one oil outlet port coupled to said oil seal for supplying oil to said oil seal, at least one overflow port in said oil seal coupled to a settling tank for returning oil from said oil seal to said settling tank, a pump supply tank coupled to said settling tank for receiving said oil from said settling tank, a pump having an input coupled to said pump supply tank for receiving oil from said pump supply tank, and an output for supplying oil under pressure, a heat exchanger having an input coupled to said output of said pump for receiving oil from said pump, and an output for supplying oil cooled by said heat exchanger, and a centrifuge for cleansing said oil, having an input coupled to said output of said heat exchanger for receiving cooled oil from said heat exchanger, and an output coupled to said pump supply tank for supplying cleansed oil to said pump supply tank, wherein said heat exchanger output is also coupled to said oil outlet port for supplying cooled oil to said oil seal.

18. The rotary carburizing furnace of claim 15 wherein a plurality of said purge inlet ports are distributed around the circumference of said slot.

19. The rotary carburizing furnace of claim 18 wherein said plurality of said purge inlet ports are distributed substantially uniformly.

20. The rotary carburizing furnace of claim 15 further comprising:

at least one carrier gas flow regulator having an input for coupling to a carrier gas source, and an output coupled to at least one of said atmosphere inlet ports, at least one hydrocarbon gas flow regulator having an input for coupling to a hydrocarbon gas source, and an output coupled to said output of at least one said carrier gas flow regulator, and at least one purge gas flow regulator having an input for coupling to a carrier gas source, and an output coupled to at least one of said purge gas inlet ports.

* * * * *